US006591575B2

(12) United States Patent
Benedettini

(10) Patent No.: US 6,591,575 B2
(45) Date of Patent: Jul. 15, 2003

(54) TILE EDGING STRIP

(76) Inventor: Robert Benedettini, 173 Mark Dr., Mt. Clemens, MI (US) 48043

( * ) Notice: Subject to any disclaimer, the term of this patent is extended or adjusted under 35 U.S.C. 154(b) by 0 days.

(21) Appl. No.: 09/753,379

(22) Filed: Jan. 2, 2001

(65) Prior Publication Data

US 2002/0046537 A1 Apr. 25, 2002

Related U.S. Application Data

(60) Provisional application No. 60/199,629, filed on Apr. 25, 2000.

(51) Int. Cl.[7] ..... E04C 2/38

(52) U.S. Cl. ..... 52/716.1; 52/287.1; 52/288.1; 52/211; 52/390; 52/716.8

(58) Field of Search ..... 52/287.1, 288.1, 52/716.1, 390, 177, 179, 211, 716.8

(56) References Cited

U.S. PATENT DOCUMENTS

D363,996 S * 11/1995 Davies
D364,233 S * 11/1995 Caley
D364,234 S * 11/1995 Caley
5,494,548 A * 2/1996 Baca
5,907,934 A * 6/1999 Austin
5,916,095 A * 6/1999 Tamlyn ..... 52/58
5,950,370 A * 9/1999 Peck ..... 52/35
6,018,924 A * 2/2000 Tamlyn ..... 52/716.8
6,238,773 B1 * 5/2001 Schluter ..... 428/192

* cited by examiner

*Primary Examiner*—Carl D. Friedman
*Assistant Examiner*—Steve Varner
(74) *Attorney, Agent, or Firm*—King & Jovanovic, PLC

(57) ABSTRACT

A tile edging strip comprising: a substrate engaging member, wherein the substrate engaging member is configured for engaging a primary substrate; a tile engaging member, wherein the tile engaging member is configured for engaging one or more tiles; a spacing support member, wherein the spacing support member is positioned between the substrate engaging member and the tile engaging member; and a transition member.

25 Claims, 9 Drawing Sheets

TILE EDGING STRIP

CROSS-REFERENCE TO RELATED APPLICATION(S)

This application claims the benefit of U.S. Provisional Application No. 60/199,629, filed Apr. 25, 2000, which hereby incorporated by reference in its entirety.

BACKGROUND OF THE INVENTION

1. Field of the Invention

The present invention relates in general to a tile edging strip, and more particularly, to a tile edging strip which is adaptable for wall and/or floor tiling applications.

2. Background Art

Tile edging strips have been identified in the art for years, and are the subject of numerous patents, including: U.S. Pat. No. 5,907,934; U.S. Pat. No. 5,494,548; U.S. Pat. No. Des. 364,234; U.S. Pat. No. Des. 364,233; and U.S. Pat. No. Des. 363,996.

U.S. Pat. No. 5,907,934 discloses an interfacing floor tile for a rectilinear flooring system comprising a top surface, a parallel bottom surface, and three side surfaces forming a right triangle. The three side surfaces are composed of a first side surface and a second side surface which form the adjacent sides of the right triangle and a third surface which forms the side opposite to the right triangle. The first side surface and the second side surface are integrally formed with an outwardly extending interlocking strip having a multitude of male interlocking members of any like tile. The first side surface, the second side surface, and the third side surface are formed with a multitude of female cavities in the bottom surface and are located in a row adjacent to the side surfaces and the cavities are positioned to mate with male connecting members of any like tile. Alternatively, the first side and the second side surface are formed with a multitude of female cavities in the bottom surface and are located in a row adjacent to the first side surface and the second side surface and the cavities are positioned to mate with male connecting members of any like tile.

U.S. Pat. No. 5,494,548 discloses a method of installing a stone tile surface comprising the steps of: (1) fixing a plurality of stone tiles to a generally planar surface to form a covering layer having a first edge; and (2) providing a first edging piece formed from additional stone tiles, comprising the steps of: (a) providing a stone tile; (b) cutting the stone tile into a plurality of strips; (c) shaping a first strip of the plurality of strips into a first side member; (d) shaping a second strip of the plurality of strips into a second side member; (e) using a third strip of the plurality of strips as a face member having a first edge and a second edge; (f) affixing the first side member and the second side member to the first edge and the second side member and the face member respectively; (g) supporting the first side member, the second side member and the face member with a base member; and (h) concealing the first edge by affixing the first edging piece to the first edge.

U.S. Pat. No. Des. 364,234; U.S. Pat. No. Des. 364,233; and U.S. Pat. No. Des. 363,996 disclose the ornamental design of tile edging strips which are configured for receiving tiles therewithin.

SUMMARY OF THE INVENTION

The present invention is directed to a tile edging strip comprising: (a) a substrate engaging member, wherein the substrate engaging member is configured for engaging a primary substrate; (b) a tile engaging member, wherein the tile engaging member is configured for engaging one or more tiles; (c) a spacing support member, wherein the spacing support member is positioned between the substrate engaging member and the tile engaging member; and (d) a transition member, wherein the transition member is associated with both the tile engaging member and the substrate engaging member.

In a preferred embodiment of the present invention the substrate engaging member, the tile engaging member, and the spacing support member define a channel, wherein the channel is configured for receiving a secondary substrate.

In another preferred embodiment of the present invention the substrate engaging member, the spacing support member, and the transition member define a slot, wherein the slot is configured for receiving a tab of a tile edging strip connector, or corner piece.

Preferably the substrate engaging member and the tile engaging member comprise one or more apertures for receiving fasteners and/or tile adhesive.

In accordance with the present invention, a lip member may be associated as an extension of the transition member and/or with the tile engaging member.

In a preferred embodiment of the present invention, the components which comprise the tile edging strip are fabricated from at least one of the group comprising: woods, metals, natural resins, synthetic resins, composites, and mixtures thereof.

In yet another preferred embodiment of the invention, the substrate engaging member comprises a wedge-shaped end for facilitating seeding of the same between a primary substrate and a secondary substrate.

The present invention is further directed to a tile edging strip comprising: (a) a substrate engaging member, wherein the substrate engaging member is configured for engaging a primary substrate; (b) a spacing support member, wherein the spacing support member is configured for engaging both a secondary substrate and one or more tiles; and (c) a transition member, wherein the transition member is associated with both the substrate engaging member and the spacing support member. In such an embodiment, the substrate engaging member, the spacing support member, and the transition member may define a slot for receiving a tab of a tile edging strip connector, or corner piece.

The present invention is also directed to a tile edging strip comprising: (a) a substrate engaging member, wherein the substrate engaging member is configured for engaging a primary substrate; (b) a tile engaging member, wherein the tile engaging member is configured for engaging one or more tiles; and (c) a transition member, wherein the transition member is associated with both the substrate engaging member and the tile engaging member. In this embodiment the substrate engaging member, the tile engaging member, and the transition member may define a channel for receiving a secondary substrate and/or a tab of a tile edging strip connector. Alternatively, tile engaging member, the transition member, and an associated primary substrate may define a channel for receiving a secondary substrate.

BRIEF DESCRIPTION OF THE DRAWINGS

The invention will now be described with reference to the drawings wherein.

DETAILED DESCRIPTION OF THE INVENTION

Figure 1:
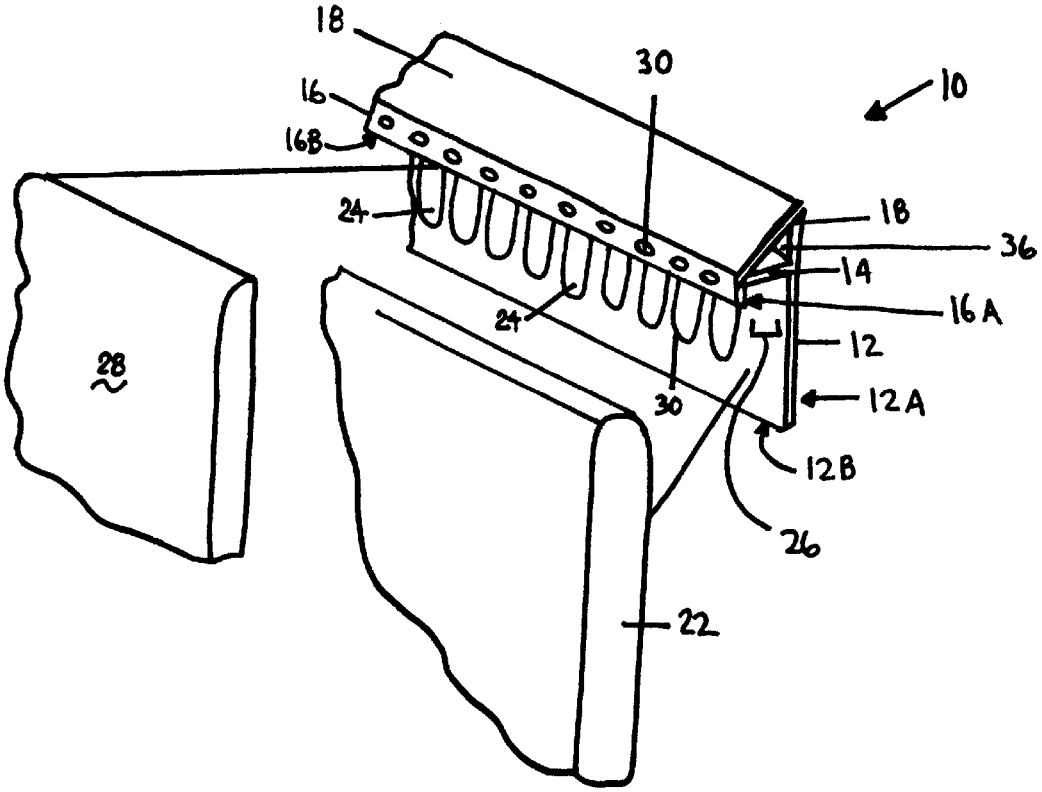
FIG. 1 of the drawings is a fragmented perspective view of a tile edging strip fabricated in accordance with the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings, and to FIG. 1 in particular, a perspective schematic representation of a first embodiment of tile edging strip 10 is shown, which generally comprises substrate engaging member 12, spacing support member 14, tile engaging member 16, and transition member 18. It will be understood that FIG. 1 is merely a schematic representation of tile edging strip 10. As such, some of the components may be distorted from their actual scale for pictorial clarity.

Substrate engaging member 12 includes first surface 12A and second surface 12B. First surface 12A is configured for association with and/or engagement to primary substrate 20 (See FIG. 2). Primary substrate 20 may comprise any one of a number of materials, including, for example, walls such as drywalls, plaster walls, brick walls, cement walls, and/or wood walls, as well as conventional floors, cement slabs, and sub-floors—depending upon the particular application. Second surface 12B is configured for association with and/or engagement to secondary substrate 22. Secondary substrate 22 may also comprise any one of a number of materials, including, but not limited to, backer board, cement board, plywood, etc.

Referring once again to FIG. 1, substrate engaging member 12 includes a plurality of apertures 24. Apertures 24 are configured to receive one or more fasteners, including threaded and non-threaded fasteners such as screws, bolts, nails, as well as pins, anchors, rivets, and/or tile adhesives or other bonding agents—just to name a few. Apertures 24 are generally oval which facilitate operative alignment of tile edging strip relative to primary substrate 20. In particular, tile edging strip 10 may be slidably displaced when one or more fasteners are partially secured within apertures 24. Such displacement can become fixed upon complete securement of one or more fasteners to tile edging strip 10 through the plurality of apertures 24. It will be understood that while apertures 24 have been disclosed as being generally oval, numerous other geometric configurations are likewise contemplated for use in accordance with the present invention, including substantially circular, substantially triangular, substantially square, substantially rectangular, substantially polygonal, substantially arbitrary, etc.

Spacing support member 14 extends contiguously from second surface 12B of substrate engaging member 12 and first surface 16A of tile engaging member 16 in a generally perpendicular vector relative to the same. Spacing support member 14 is positioned between juxtaposed portions of substrate engaging member 12 and tile engaging member 16, respectively. Spacing support member 14, in cooperation with substrate engaging member 12 and tile engaging member 16, define channel 26, which is configured for controllably receiving secondary substrate 22. Spacing support member 14 also serves to increase the structural rigidity of tile engaging strip 10.

Tile engaging member 16 includes first surface 16A and second surface 16B. First surface 16A is configured for association with and/or engagement to secondary substrate 22. Second surface 16B is configured for association with and/or the secure receipt of one or more tiles 28. Tiles 28 may be fabricated from numerous materials, including ceramic, marble, porcelain, natural stone—or other materials known in the art.

Referring again to FIG. 1, tile engaging member 16 includes a plurality of apertures 30. As will be discussed in greater detail below, apertures 30 are configured to receive and dissipate tile adhesive used to secure tiles 28 to tile engaging member 16 and secondary substrate 22. They, too, may receive one or more of various types of fasteners for additional support.

Figure 2:
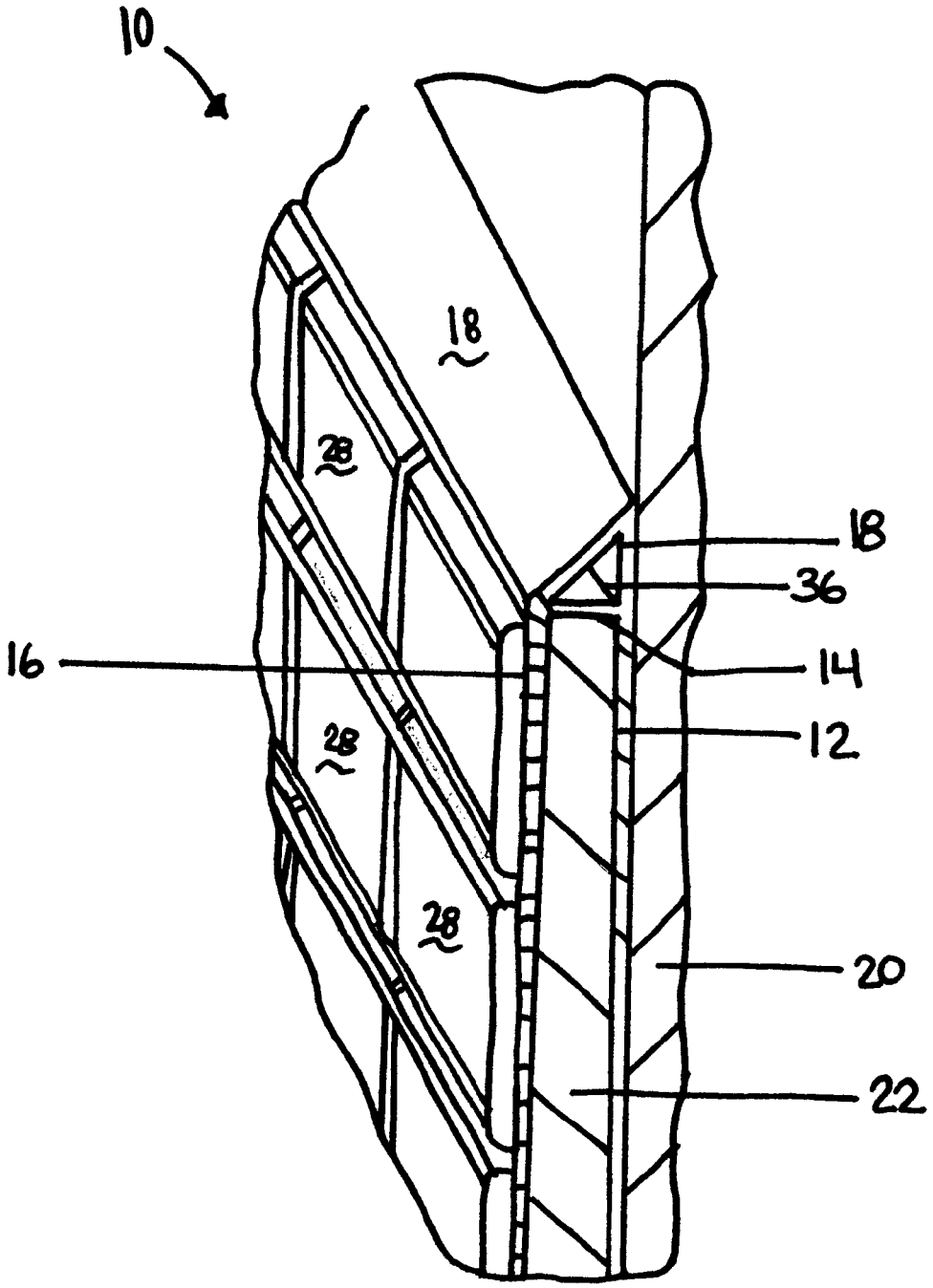
FIG. 2 of the drawings is a fragmented perspective view of a tile edging strip fabricated in accordance with the present invention associated with a primary substrate, a secondary substrate, and a plurality of tiles.

Transition member 18 extends contiguously from juxtaposed upper portions of substrate engaging member 12 and tile engaging member 16. As is best shown in FIG. 2, transition member 18 provides for a clean, finished transition between the edges of one or more tiles 28, secondary substrate 22, and primary substrate 20. For purposes of the present disclosure, transition member 18 is preferably fabricated from a material which enables painting thereon. As such, transition member 18 may be painted or primed for painting. Alternatively, transition member 18 may remained unpainted—for example, the transition member may be fabricated from brushed or polished metal, such as aluminum stainless steel, or brass, to name a few, or from a natural or synthetic resin or composite. It will be understood that transition member 18 may be generally linear as is shown in FIGS. 1–3, or, alternatively generally arcuate as is shown FIG. 4D.

Figure 3A:
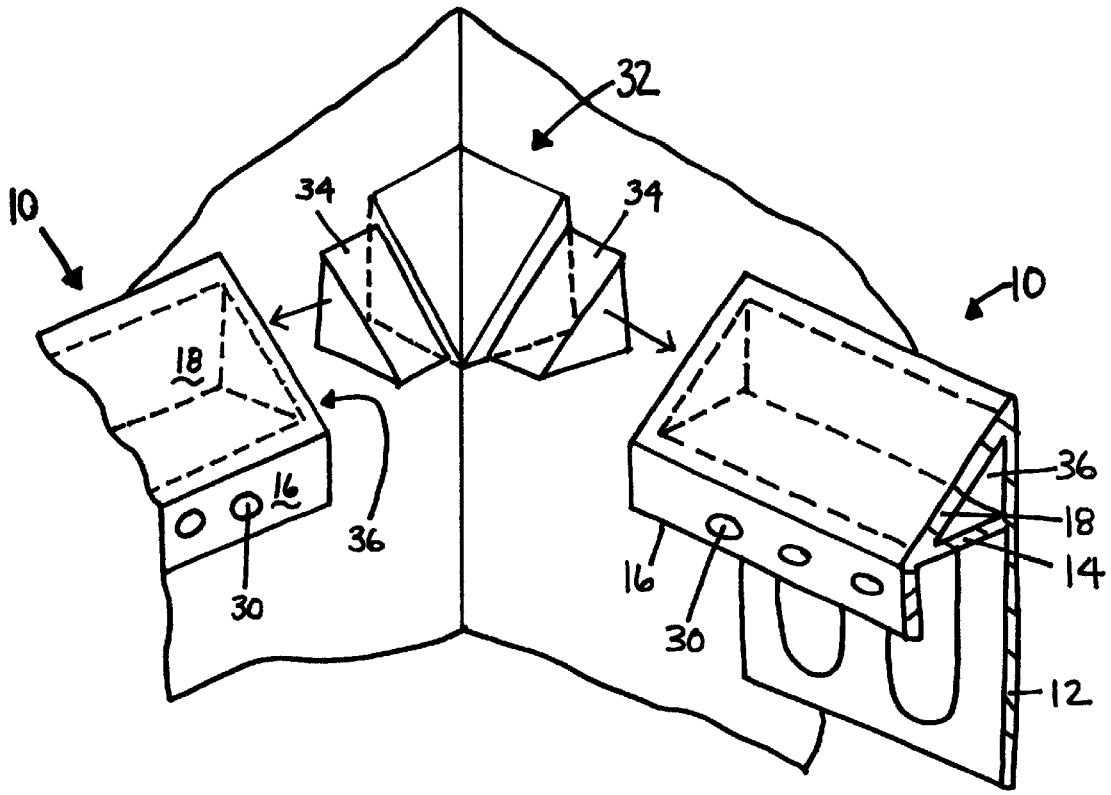
FIGS. 3A–3C of the drawings are fragmented perspective views of tile edging strips associated with corner connectors fabricated in accordance with the present invention.
Figure 3B:
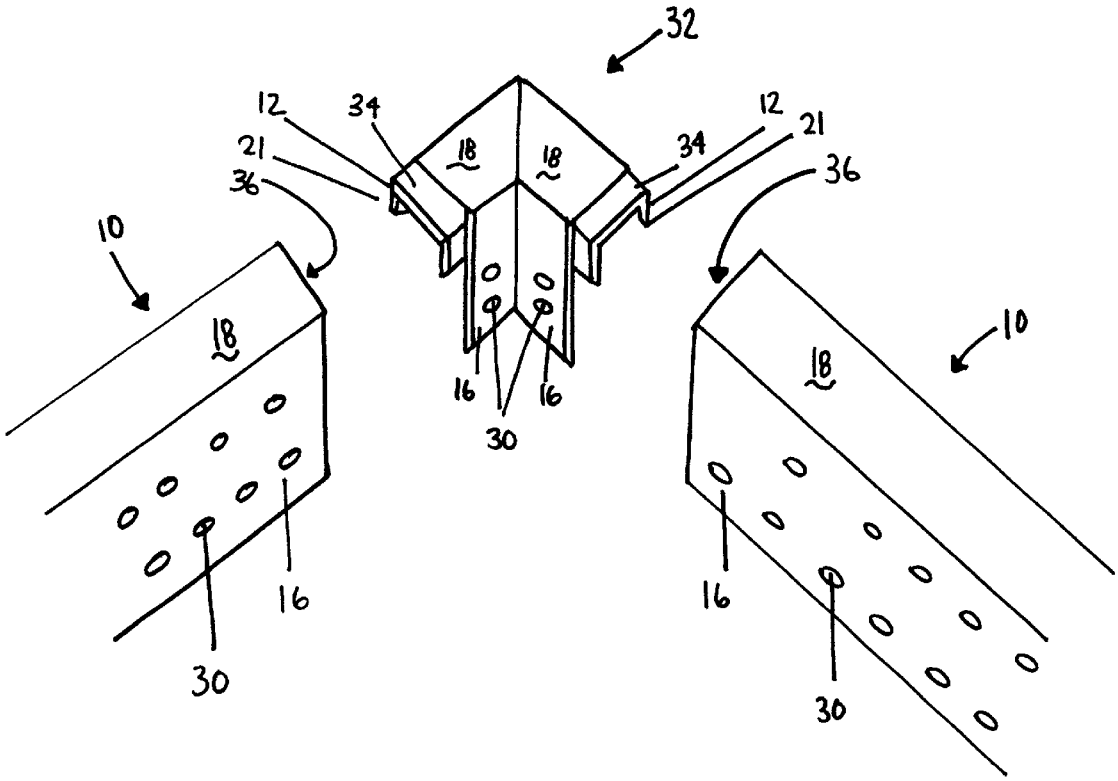
Figure 3C:
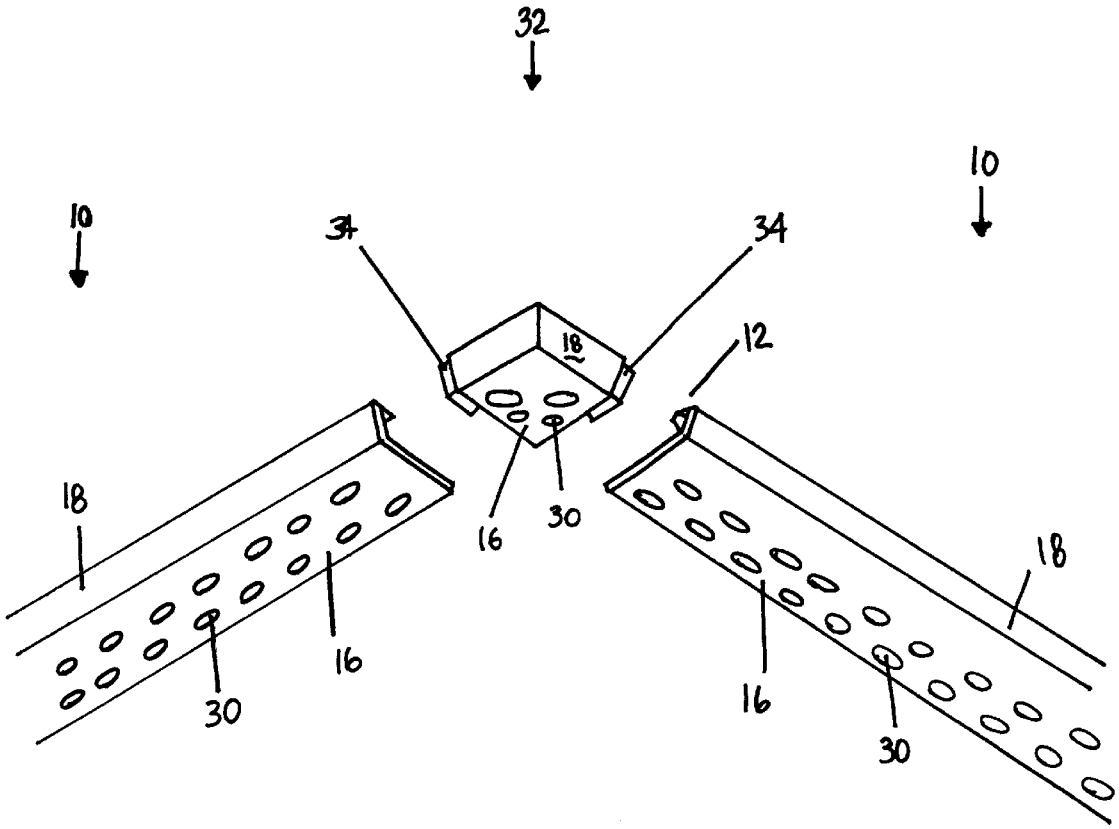

As is shown in FIGS. 3A–3C, a pair of tile edging strips 10 may become integrally associated within one another via connector 32. Connector 32 can be used to mate a pair of tile edging strips near, for example, a corner area. Connector 32 includes one or more tabs 34, which preferably comprise an outer peripheral geometry which mates with the inner peripheral geometry of slot 36, which is cooperatively defined by substrate engaging member 12, spacing support member 14, and transition member 18 in FIG. 3A, and cooperatively defined by substrate engaging member 12, tile engaging member 16, and transition member 18 in FIGS. 3B and 3C. For purposes of the present disclosure, tabs and slots 34 and 36, respectively, are shown as comprising substantially triangular and/or rectangular cross-sections. However, it will be understood that tabs 34 and slots 36 may be characterized by numerous other cross-sections that would be known to those having ordinary skill in the art having the present disclosure before.

Figure 4A:
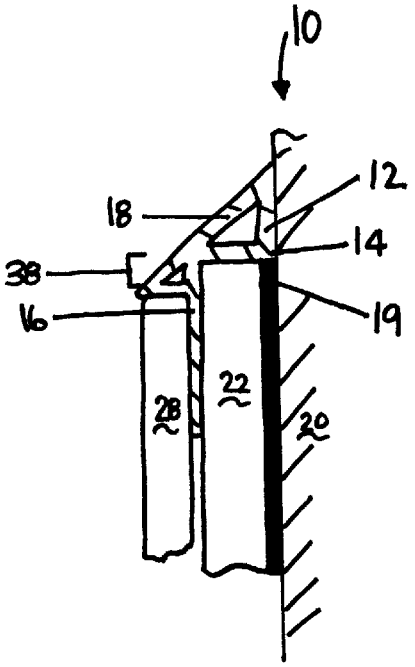
FIGS. 4A–4G of the drawings are cross-sectional views of a plurality of embodiments of tile edging strips fabricated in accordance with the present invention.
Figure 4B:
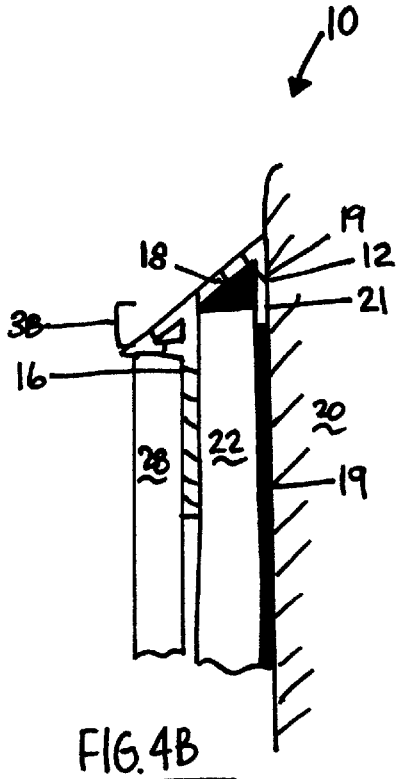

Referring now to FIG. 4A, a cross-sectional schematic representation of a second embodiment of tile edging strip 10 is shown, which generally comprises substrate engaging member 12, spacing support member 14, tile engaging member 16, transition member 18, and lip member 38. Lip member 38 serves as least two functions. First, lip member 38 provides structural support for floor applications, where the tile/tile edging strip interface may be exposed to substantial force by an individual walking over the same. Second, lip member 38 enables a tile installer to use flat, non-bull nosed tiles which can be substantially less expensive than fabricated bull-nose tiles. FIGS. 4B, 4C, 4E, and 4F disclose similar embodiments, which are void of spacing support member 14. In such embodiments, substrate engaging member 12, tile engaging member 16, and transition member 18 define a channel for receiving secondary substrate 22.

Figure 4C:
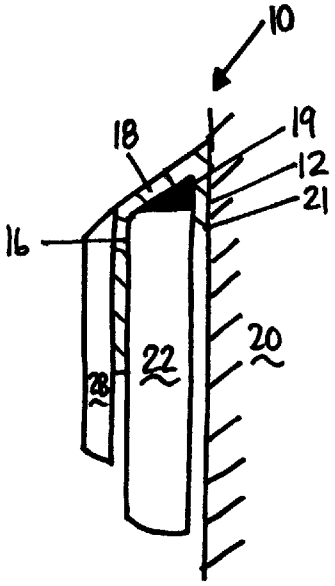
Figure 4D:
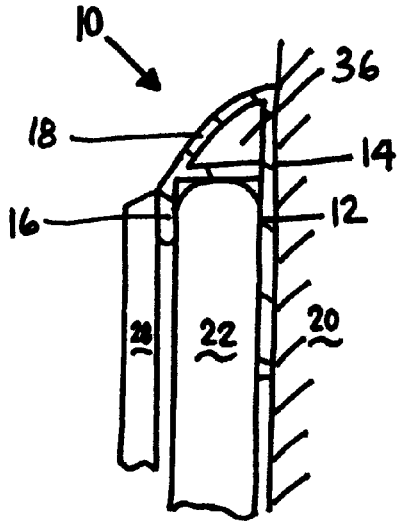
Figure 4E:
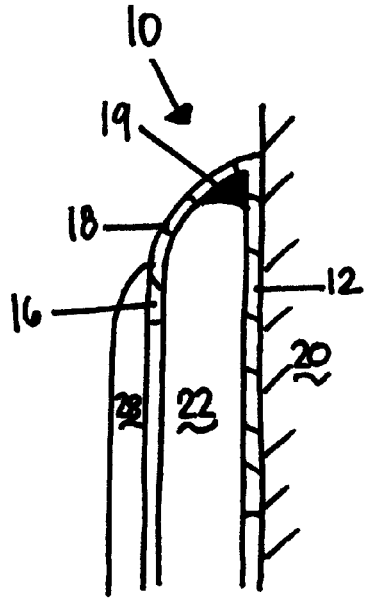
Figure 4F:
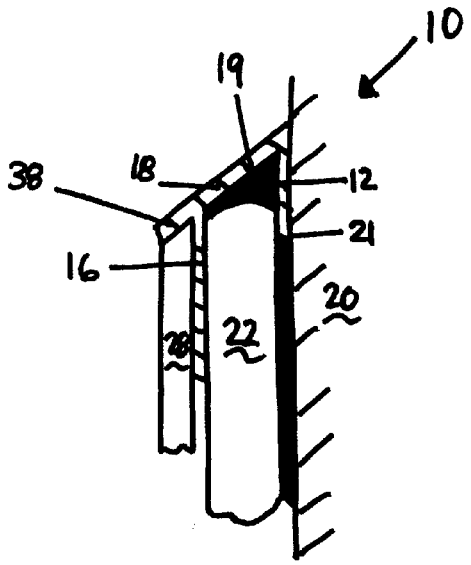

As is shown in FIG. 4C, substrate engaging member 12 may include a pointed or wedge-shaped end 21 which facilitates seeding of the substrate engaging member 12, and, in turn, tile edging strip 10, between primary substrate 20 and secondary substrate 22. A conventional bonding agent 19 can be associated with tile edging strip 10 to secure the same to secondary substrate 22, and also primary substrate 20.

Figure 4G:
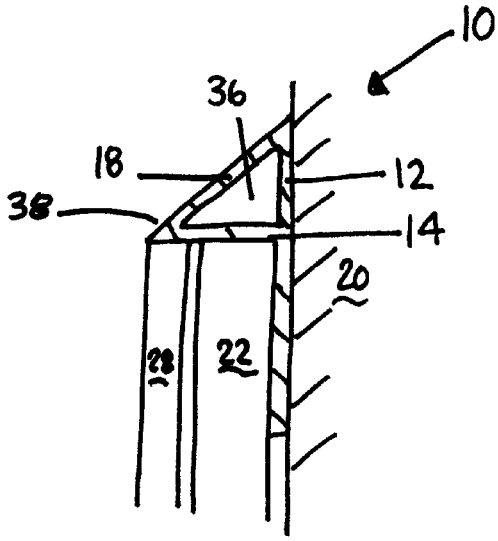

As is shown in FIG. 4G, an alternative embodiment comprises substrate engaging member 12, spacing support member 14, and transition member 18, which protrudes to form lip member 38. In this embodiment substrate engaging member 12, spacing support member 14, and transition member 18 define slot 36 for receiving a tab of a tile edging strip connector (See FIG. 3).

Figure 5:
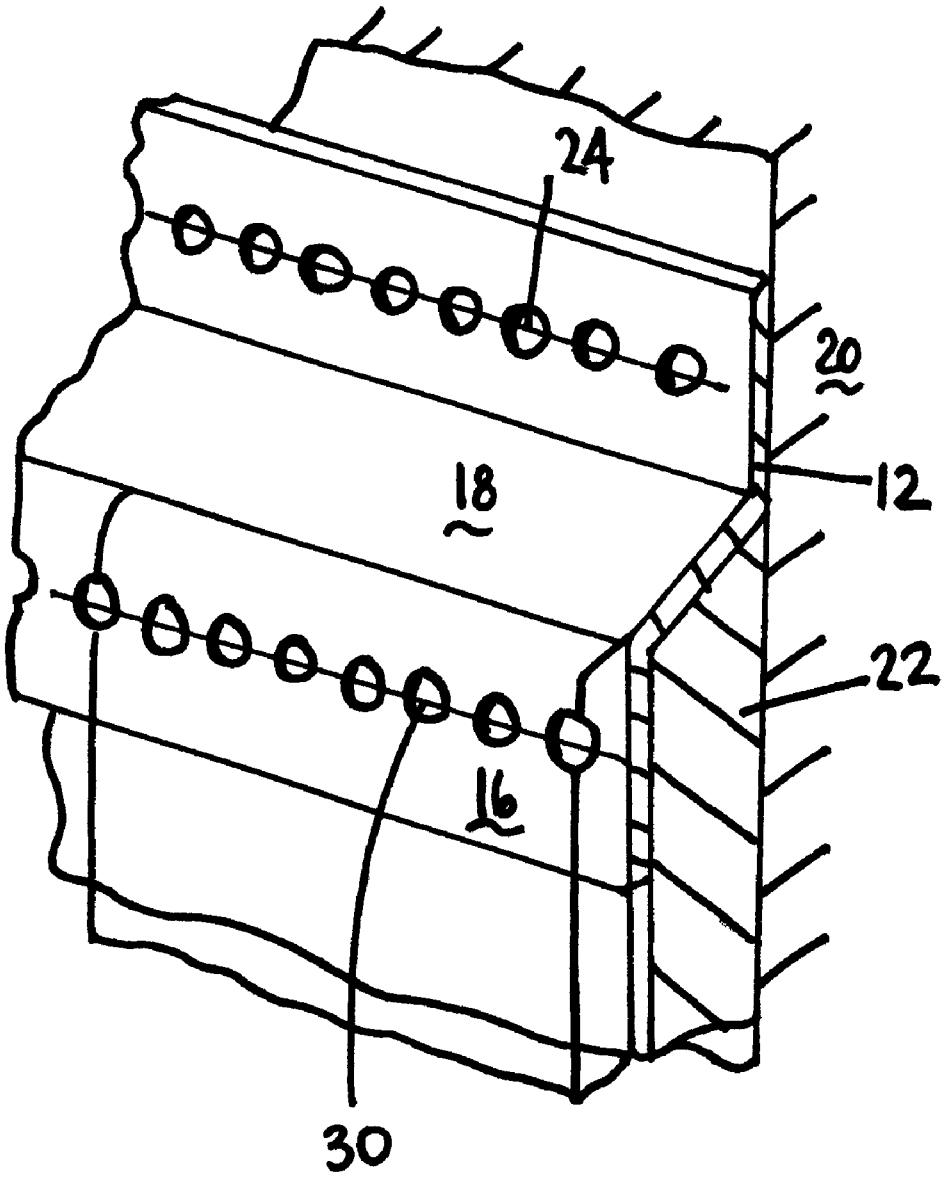
FIG. 5 of the drawings is a perspective view of an additional embodiment of a tile edging strip fabricated in accordance with the present invention.

Referring now to FIG. 5, a perspective schematic representation of an additional alternative embodiment of tile edging strip 10 is shown, which generally comprises to substrate engaging member 12, tile engaging member 16, and transition member 18. In this embodiment tile engaging member 16, transition member 18, and primary substrate 20 define a channel for receiving secondary substrate 22.

It will be understood that the components of tile edging strip 10 may be integrally or independently fabricated from numerous materials, including at least one of the group comprising woods, metals, natural resins, synthetic resins, composites, and mixtures thereof.

Tile edging strip 10 can be installed according to numerous methods including the following. First, substrate engaging member 12 of tile edging strip 10 is controllably applied to a primary substrate, and subsequently fastened to the primary substrate with fasteners and/or an adhesive. Next, a secondary substrate, such as backer board or cement board, is inserted into a predefined channel. The secondary substrate may then be secured to the primary substrate using conventional methods, including fasteners and/or adhesives. After the secondary substrate is secured to the primary substrate, one or more tiles can be applied to the secondary substrate and the tile engaging member using conventional methods—including applying adhesive to apertures associated with the tile engaging member. After the tiles are secured, grout or chalk is optionally applied into any spacing between the tiles themselves, the tiles and the transition member, the tiles and the lip member, as well as the transition member and the primary substrate.

It will be understood that while the above-identified method has been disclosed, for illustrative purposes only, numerous other methods are likewise contemplated for use including applying tile edging strip 10 before or after the secondary substrate has been applied to the primary substrate.

Use of tile edging strip 10 is highly desirous because conventional tile installation requires substantial labor in finishing "edges" of a particular installation. However, tile edging strip 10 enables an installer to quickly provide for a convenient and economical professional finish and transition from the tile edge to the primary substrate.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A tile edging strip, comprising:

a substrate engaging member, wherein the substrate engaging member is configured for engaging a primary substrate;

a tile engaging member, wherein the tile engaging member is configured for engaging one or more tiles;

a spacing support member, wherein the spacing support member is positioned between the substrate engaging member and the tile engaging member;

a transition member, wherein the transition member is positioned with both the tile engaging member and the substrate engaging member; and a lip member attached with an extension of the transition member.

2. The tile edging strip according to claim 1, wherein the substrate engaging member, the tile engaging member, and the spacing support member define a channel, wherein the channel is configured for receiving a secondary substrate.

3. The tile edging strip according to claim 2, wherein the substrate engaging member, the spacing support member, and the transition member define a slot, wherein the slot is configured for receiving a tab of a file edging strip connector, or corner piece.

4. The tile edging strip according to claim 1, wherein the substrate engaging member, the spacing support member, and the transition member define a slot, wherein the slot is configured for receiving a tab of a tile edging strip connector, or corner piece.

5. The tile edging strip according to claim 1, wherein the substrate engaging member further comprises one or more apertures for receiving fasteners and/or an adhesive therein.

6. The tile edging strip according to claim 1, wherein the tile engaging member further comprises one or more apertures for receiving fasteners and/or an adhesive therein.

7. The tile edging strip according to claim 1, wherein the substrate engaging member, the tile engaging member, the spacing support member, and the transition member are fabricated from at least one of the group consisting of wood, metal, a natural resin, a synthetic resin, composites, and mixtures thereof.

8. The tile edging strip according to claim 1, wherein the substrate engaging member comprises a wedge-shaped end for facilitating seeding of the same between the primary substrate and a secondary substrate.

9. A tile edging strip, for transitioning between a primary substrate and tile and for transitioning across a secondary substrate positioned between the primary substrate and the tile, the tile edging strip comprising:

a substrate engaging member, wherein the substrate engaging member is configured for engaging a primary substrate;

a spacing support member, wherein the spacing support member is configured for engaging both a secondary substrate and one or more tiles;

a transition member, wherein the transition member is associated both the substrate engaging member and the spacing support member; and a lip member associated with an extension of the transition member.

10. The tile edging strip according to claim 9, wherein the substrate engaging member, the spacing support member, and the transition member define a slot for receiving a tab of a tile edging strip connector, or corner piece.

11. The tile edging strip according to claim 9, wherein the substrate engaging member, the spacing support member, and the transition member are fabricated from at least one of the group consisting of wood, metal, a natural resin, a synthetic resin, composites, and mixtures thereof.

12. The tile edging strip according to claim 9, wherein the substrate engaging member comprises a wedge-shaped end for facilitating seeding of the same between the primary and secondary substrates.

13. The tile edging strip according to claim 9, wherein the substrate engaging member further comprises one or more apertures for receiving fasteners and/or an adhesive therein.

14. The tile edging strip according to claim 9, wherein the tile engaging member further comprises one or more apertures for receiving fasteners and/or an adhesive therein.

15. A tile edging strip, comprising:

a substrate engaging member, wherein the substrate engaging member is configured for engaging a primary substrate;

a tile engaging member, wherein the tile engaging member is configured for engaging one or more tiles;

a transition member, wherein the transition member is positioned both the substrate engaging member and the tile engaging member; and a lip member associated with an extension of the transition member.

16. The tile engaging strip according to claim 15, wherein the substrate engaging member, the tile engaging member, and the transition member define a channel for receiving a secondary substrate, and a bonding agent.

17. The tile edging strip according to claim 15, wherein the tile engaging member, the transition member, and an associated primary substrate define a channel for receiving a secondary substrate, and a bonding agent.

18. The tile edging strip according to claim 15, wherein the substrate engaging member, the tile engaging member, and the transition member are fabricated from at least one of the group consisting of wood, metal, a natural resin, a synthetic resin, composites, and mixtures thereof.

19. The tile edging strip according to claim 15, wherein the substrate engaging member comprises a wedge-shaped end for facilitating seeding of the same between the primary substrate and a secondary substrate.

20. The tile edging strip according to claim 15, wherein the substrate engaging member, the transition member, and the tile engaging member define a slot, wherein the slot is configured for receiving a tab of a tile edging strip connector, or a corner piece.

21. The tile edging strip according to claim 15, wherein the substrate engaging member further comprises one or more apertures for receiving fasteners and/or an adhesive therein.

22. The tile edging strip according to claim 15, wherein the tile engaging member further comprises one or more apertures for receiving fasteners and/or an adhesive therein.

23. A tile edging strip, for transitioning between a primary substrate and tile and for transitioning across a secondary substrate positioned between the primary substrate and the tile, the tile edging strip comprising:

a substrate engaging member, wherein the substrate engaging member is configured for engaging a primary substrate;

a tile engaging member, wherein the tile engaging member is configured for engaging one or more tiles;

a spacing support member, wherein the spacing support member is positioned between the substrate engaging member and the tile engaging member;

a transition member, wherein the transition member is positioned so as to be substantially flush with both the tile engaging member and the substrate engaging member, to provide a transition which precludes the collection of material between the tile and the primary substrate; and a lip member attached as an extension of the transition member.

24. A tile edging strip, for transitioning between a primary substrate and tile and for transitioning across a secondary substrate positioned between the primary substrate and the tile, the tile edging strip comprising:

a substrate engaging member, wherein the substrate engaging member is configured for engaging a primary substrate;

a spacing support member, wherein the spacing support member is configured for engaging both a secondary substrate and one or more tiles;

a transition member, wherein the transition member is positioned so as to be substantially flush with both the substrate engaging member and the spacing support member, to provide a transition which precludes the collection of material between the tile and the primary substrate; and a lip member attached as an extension of the transition member.

25. A tile edging strip, for transitioning between a primary substrate and tile and for transitioning across a secondary substrate positive between the primary substrate and the tile, the tile edging strip comprising:

a substrate engaging member, wherein substrate engaging member is configured for engaging a primary substrate;

a tile engaging member, wherein the tile engaging member is configured for engaging one or more tiles;

a transition member wherein the transition member is positioned so as to be substantially flush with the substrate engaging member and the tile engaging member, to provide a transition which precludes the collection of material between the tile and the primary substrate; and a lip member attached as an extension of the transition member.

* * * * *